US012337380B1

(12) United States Patent
Chou

(10) Patent No.: US 12,337,380 B1
(45) Date of Patent: Jun. 24, 2025

(54) METHOD FOR MANUFACTURING GRAPHENE ALUMINUM CASTING

(71) Applicant: VOLANS UNITED CORPORATION, Taipei (TW)

(72) Inventor: Yu-Ta Chou, Taipei (TW)

(73) Assignee: VOLANS UNITED CORPORATION, Taipei (TW)

( * ) Notice: Subject to any disclaimer, the term of this patent is extended or adjusted under 35 U.S.C. 154(b) by 0 days.

(21) Appl. No.: 18/828,538

(22) Filed: Sep. 9, 2024

(30) Foreign Application Priority Data

Aug. 2, 2024 (TW) ..... 113128945

(51) Int. Cl.
*B22D 21/00* (2006.01)
*B22C 9/03* (2006.01)
*B22D 18/06* (2006.01)

(52) U.S. Cl.
CPC ..... *B22D 21/007* (2013.01); *B22C 9/03* (2013.01); *B22D 18/06* (2013.01)

(58) Field of Classification Search
CPC ..... B22C 9/03; B22D 18/06; B22D 21/00; B22D 21/007
USPC ..... 164/61, 65, 97
See application file for complete search history.

(56) References Cited

U.S. PATENT DOCUMENTS 4,157,109 A * 6/1979 Toyoda et al. ..... B22C 9/03 164/7.2
2009/0242160 A1* 10/2009 Obara et al. ..... B22C 9/046 164/520

FOREIGN PATENT DOCUMENTS

CN 1375367 A * 10/2002 ..... B22C 9/03

OTHER PUBLICATIONS

Machine translation of CN 1375367 A (Year: 2002).*

* cited by examiner

*Primary Examiner* — Kevin P Kerns
(74) *Attorney, Agent, or Firm* — Sinorica International Patent & Trademark

(57) ABSTRACT

A method for manufacturing graphene aluminum casting where special sand boxes are used together with vacuum evacuation to harden dry sand between two pieces of EVA film, thereby producing an upper mold box and a lower mold box for aluminum casting. The molten aluminum used to cast a graphene aluminum casting is evenly mixed with graphene powder, so there is a certain proportion of graphene inside the graphene aluminum casting. And because there is a thin layer of graphene powder on the surface of one of the EVA films, these graphene powder will adhere to the surface of the graphene aluminum casting without falling off.

7 Claims, 6 Drawing Sheets

METHOD FOR MANUFACTURING GRAPHENE ALUMINUM CASTING

FIELD OF THE INVENTION

The present invention relates to a method to make heat dissipation objects. More particularly, the present invention relates to a method for manufacturing graphene aluminum casting.

BACKGROUND OF THE INVENTION

Many apparatuses around us contain electronic devices. These electronic devices either serve as control subjects or are used to provide specific functions for the apparatuses. One of the characteristics of electronic devices is that they generate heat. Heat comes from electrical energy after work has been done. As electronic devices become more versatile and intelligent, the problem of heat generation becomes more serious. High heat may make the user feel uncomfortable at least, or may cause burns in severe cases. Many high-heat electronic devices use heat dissipation systems to quickly dissipate internal heat to the nearest external area, or to a side not facing users. Regardless of the design philosophy of the heat dissipation systems, the use of fast and effective heat dissipation materials is necessary. The above common heat dissipation problems in electronic devices also occur in other mechanical heating devices.

Commonly used hard heat dissipation materials are metals, such as copper and aluminum. The former is used for heat conduction inside a device, while the latter is often used for external heat dissipation and internal component protection of the device due to its light weight and high strength. In terms of liquid materials, commonly used heat dissipation materials include water, heat dissipation oil, heat dissipation paste, etc., and even uncondensed heat dissipation glue is used as a binding material. Most of these materials need to work together with solid heat dissipation materials. In recent years, graphene has become a rising star in heat dissipation materials and is widely used in the industry. Graphene has the advantages of high thermal conductivity and light weight, and can be used as a medium for rapid heat conduction inside a heating device. Since graphene is in powder form, it is not easy to polymerize on the surface of objects that need to dissipate heat. Generally, heat dissipation glue is used together with it. In addition, to conducts heat from graphene to the outside, it also needs to be closely connected to the aluminum casing. However, bonding between graphene and the aluminum casing is limited by the aspect of the graphene, which makes it easy to detach. As a result, the heat dissipation performance of the product becomes worse after being used for a period of time.

The invention was proposed to solve the above-mentioned problem of combining graphene and aluminum materials.

SUMMARY OF THE INVENTION

This paragraph extracts and compiles some features of the present invention; other features will be disclosed in the follow-up paragraphs. It is intended to cover various modifications and similar arrangements included within the spirit and scope of the appended claims.

In order to solve the problem of combining graphene and aluminum materials mentioned above, further manufacturing a graphene aluminum casting with combination of graphene and aluminum, a method for manufacturing graphene aluminum casting is disclosed in the present invention. The method comprises steps of: a) heating a first EVA (Ethylene Vinyl Acetate) film to soften, then placing the first EVA film on a surface of a first mold, wherein the first mold is placed above an exhaust box, the exhaust box exerts negative pressure between the first EVA film and the first mold to make the first EVA film closely adhere to an upper surface of the exhaust box, and graphene powder is sprinkled evenly on a surface of the first EVA film above the first mold; b) placing a first sand box on the first EVA film, sealing the first sand box with an upper plane of the exhaust box through the first EVA film, pouring dry sand into the first sand box and shaking the first sand box to increase dry sand density and fill all parts of the first sand box with the dry sand; c) smoothing dry sand surface, placing a sprue cup in the dry sand, placing a heated and softened second EVA film on the dry sand covering the first sand box, exerting negative pressure between the first EVA film, the second EVA film and the first sand box through the first sand box to harden the dry sand, and then releasing the negative pressure exerted by the exhaust box to separate the first EVA film and the first mold, thereby forming an upper box; d) using a third EVA film, a fourth EVA film, a second mold 12 and a second sand box to replace the first EVA film, the second EVA film, the first mold and the first sand box respectively and cancelling the use of the sprue cup to repeat step a) to step c) so as to form a lower box; e) assembling the upper box and the lower box with a casting space and a sprue formed therebetween, and sprinkling graphene powder on a portion of the second EVA film above the sprue cup; f) adding graphene powder to the smelting aluminum liquid and mixing, and pouring the mixed smelting aluminum liquid to the portion of the second EVA film above the sprue cup, wherein after vaporizing the portion of the second EVA film above the sprue cup, the mixed smelting aluminum liquid goes through the sprue to fill the casting space; and g) cooling the smelting aluminum liquid to a solid state, releasing the negative pressure exerted to the two sand boxes, and taking out a graphene aluminum casting formed in the casting space.

According to the present invention, the negative pressure may be between 200 mmHg and 400 mmHg.

According to the present invention, particle size of the dry sand may be between 0.15 mm and 0.075 mm.

According to the present invention, temperature of the smelting aluminum liquid may be between 750° C. and 790° C.

According to the present invention, the first sand box and the second sand box both comprise: a square hollow frame, having an annular slotting formed on an inner side thereof and at least one connecting pipe installed on an outer side thereof; and four filter strips, each filter strip fixed on one linear section of the annular slotting respectively, comprising: two long metal plates, having a plurality of ventilation holes formed correspondingly; and a long metal filter, fixed between the two long metal plates, allowing air to circulate but blocking dry sand from passing through. Preferably, the long metal filter is tin phosphorus mesh.

According to the present invention, the first mold and the second mold 12 both have multiple exhaust holes, so that the exhaust box is able to exert negative pressure through the exhaust holes.

In this invention, special sand boxes are used together with vacuum evacuation to harden dry sand between two pieces of EVA film, thereby producing an upper mold box and a lower mold box for aluminum casting. The molten aluminum used to cast a graphene aluminum casting is evenly mixed with graphene powder, so there is a certain proportion of graphene inside the graphene aluminum casting. And because there is a thin layer of graphene powder on the surface of one of the EVA films, these graphene powder will adhere to the surface of the graphene aluminum casting without falling off. The present invention solves the problem that graphene and aluminum materials are easily separated after being combined.

DETAILED DESCRIPTION OF THE PREFERRED EMBODIMENTS

The present invention will now be described more specifically with reference to the following embodiments.

Figure 1:
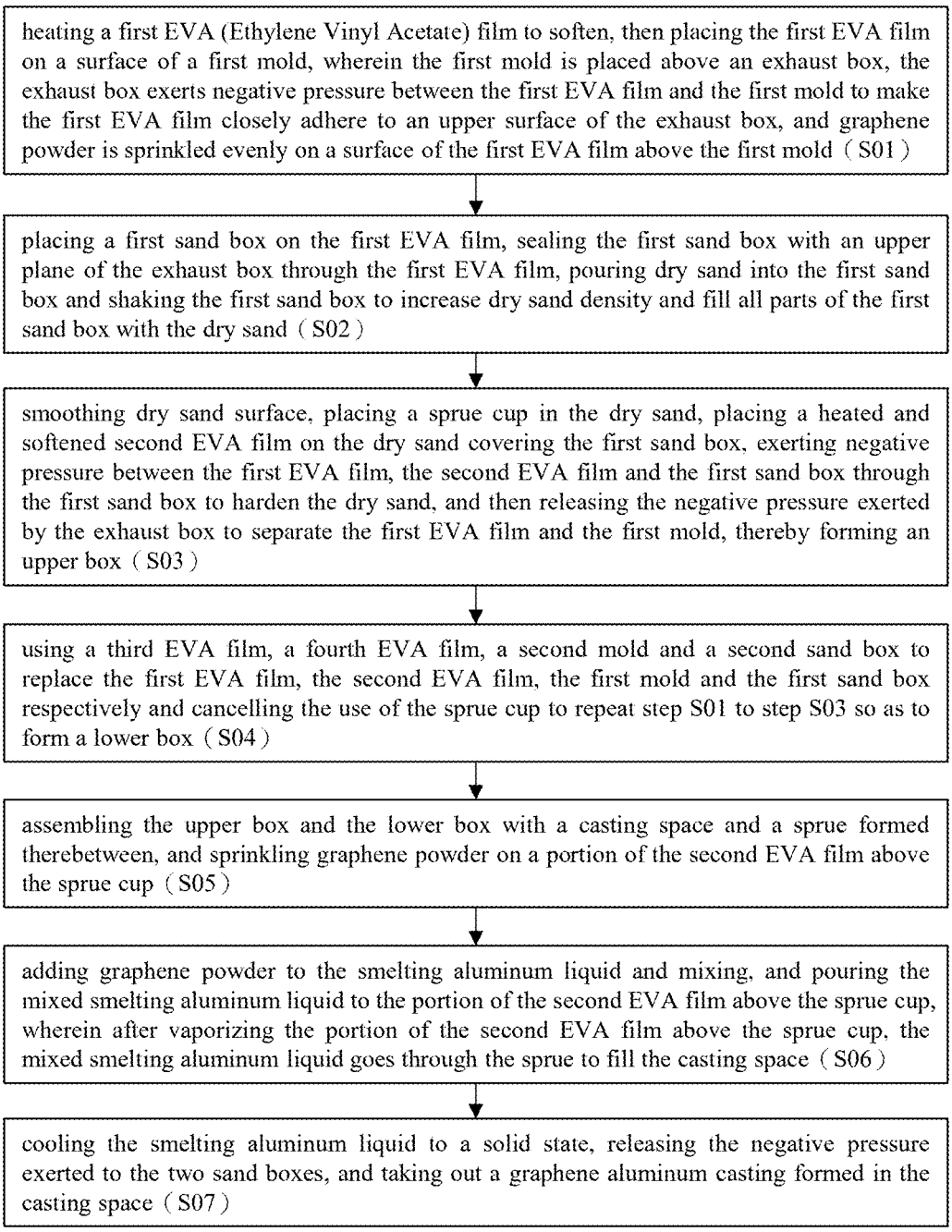
FIG. 1 is a flow chart of an embodiment of a manufacturing method of graphene aluminum casting according to the present invention.
Figure 2:
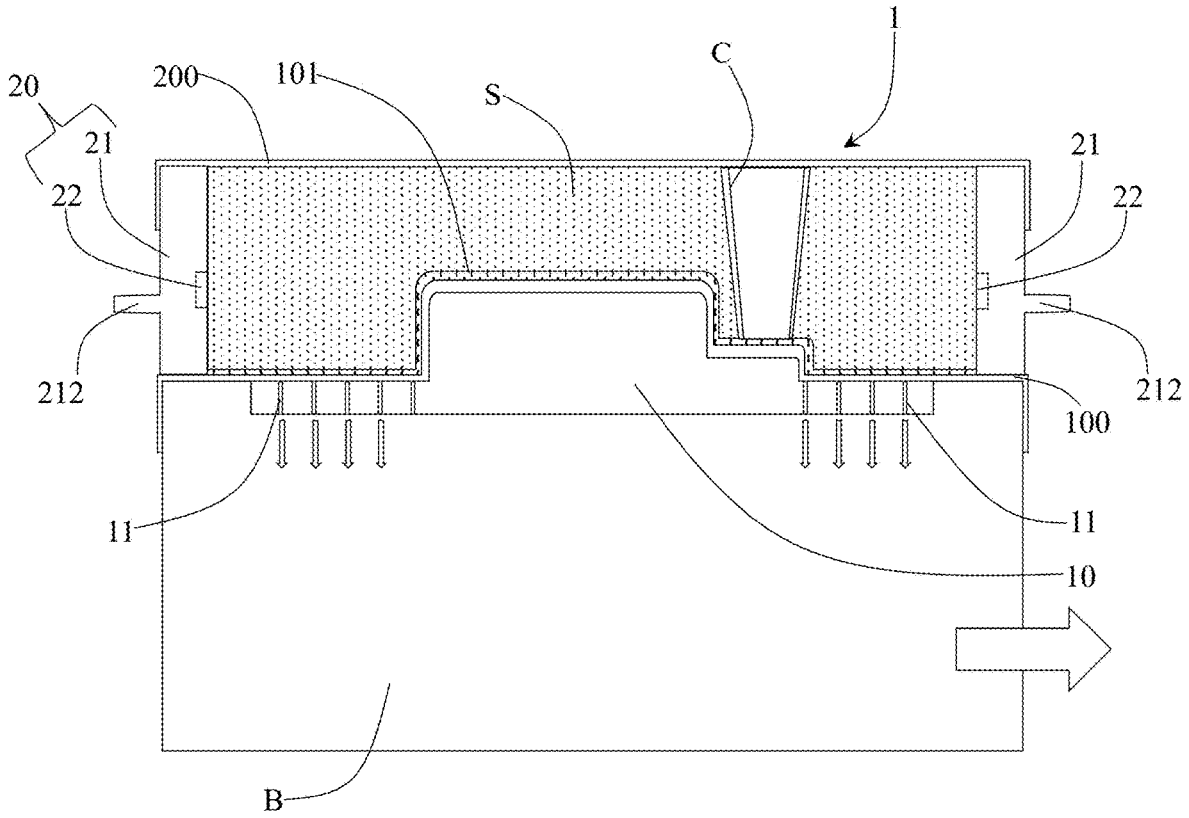
FIG. 2 illustrates how to make an upper box.

See FIG. 1. It is a flow chart of an embodiment of a manufacturing method of graphene aluminum casting (hereinafter referred to as the method) according to the present invention. A first step of the method is heating a first EVA (Ethylene Vinyl Acetate) film to soften, then placing the first EVA film on a surface of a first mold, wherein the first mold is placed above an exhaust box, the exhaust box exerts negative pressure between the first EVA film and the first mold to make the first EVA film closely adhere to an upper surface of the exhaust box, and graphene powder is sprinkled evenly on a surface of the first EVA film above the first mold (S01). For a better understanding of this step, see FIG. 2. FIG. 2 is a cross-sectional view showing how to make an upper box. It should be noted that in the drawings of the present invention, for the convenience of explanation, the length, width and height dimensions of each component may not be shown according to actual cases. For example, the thickness of EVA film is very thin compared to the sand box, and it will be almost invisible if drawn according to the actual size. For example, the length of the sand box is generally much larger than the height of the mold and drawing according to the actual proportion will cause the drawing to be too flat. Many details cannot be noticed. Therefore, dimensions and proportions between components in the drawings do not limit the present invention.

The first mold 10 in FIG. 2 is fixedly placed on exhaust box B. The upper surface of the first mold 10 forms the upper half of the graphene aluminum casting and the appearance of the sprue, and the lower surface is flat so as to be in close contact with the upper surface of exhaust box B. A number of exhaust holes 11 are provided between the upper and lower surfaces of the first mold 10. Relatively, the upper surface of the exhaust box B also has a number of suction holes (not shown), through which the air on the upper surface of the first mold 10 can be sucked in through the exhaust holes 11. When the first EVA film 100 is heated and softened (for example, heated to about 70° C. by a heater to increase the elongation rate and the plastic deformation rate), and is placed on the upper surface of the first mold 10, the exhaust box B can suck out part of the air between the first EVA film 100 and the first mold 10 (indicated by the vertical hollow arrows in FIG. 2). Thereby, negative pressure is exerted between the first EVA film 100 and the first mold 10 through the exhaust holes 11, so that the two are in close contact with each other. Negative pressure is pressure below chamber pressure (one atmosphere, 760 mmHg). According to the present invention, considering the pressure difference that the EVA film can withstand, the negative pressure can be between 200 mmHg and 400 mmHg, such as 300 mmHg used in this embodiment. On the side of the first EVA film 100 that is not in contact with the first mold 10, above the first mold 10, the thickness of the graphene powder layer 101 is related to the size of the graphene aluminum casting and the graphene concentration required on the surface. The thickness can be adjusted according to actual needs (graphene powder dosage). For example, in this embodiment, the upper surface area of the first mold 10 is 50 cm×50 cm, and 50 grams of graphene is used.

Figure 3:
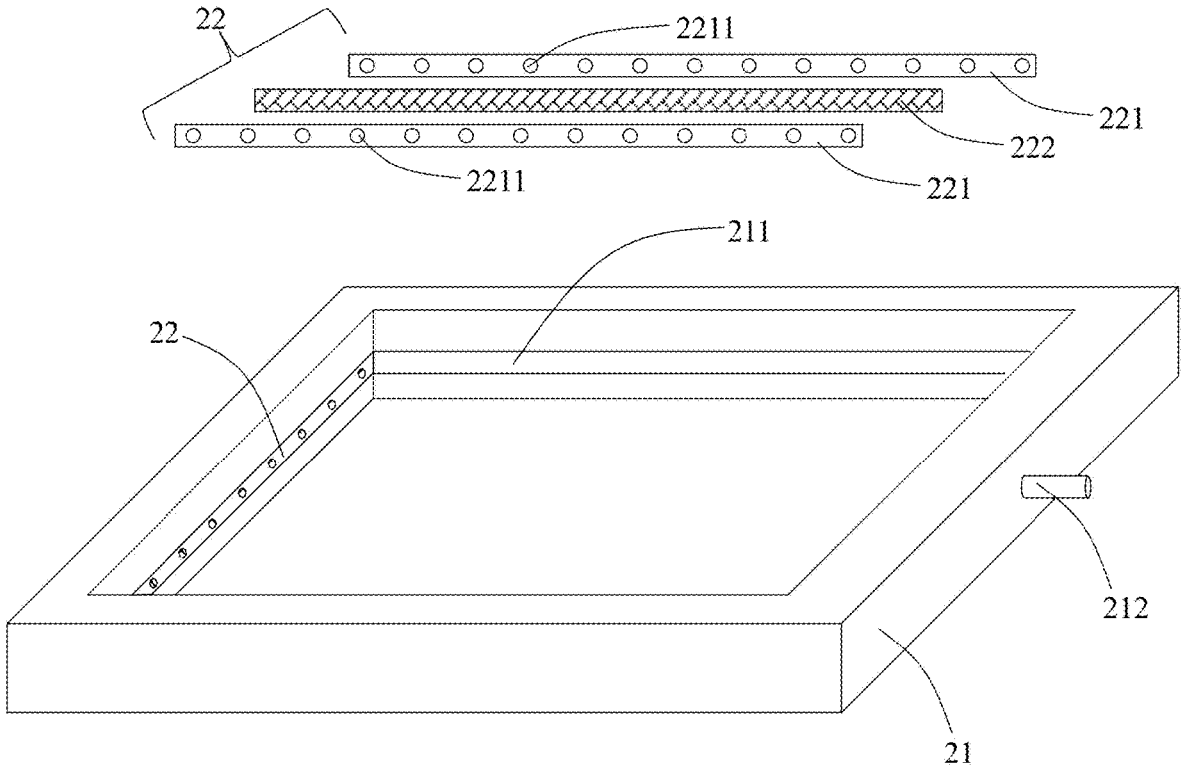
FIG. 3 shows the structure of a first sand box.

A second step of the method is placing a first sand box 20 on the first EVA film 100, sealing the first sand box 20 with an upper plane of the exhaust box B through the first EVA film 100, pouring dry sand S into the first sand box 20 and shaking the first sand box 20 to increase dry sand S density and fill all parts of the first sand box 20 with the dry sand S (S02). The first sand box 20 in the present invention, along with a second sand box mentioned later, are different from the traditional sand box structure used in casting. The first sand box 20 and the second sand box both have the same structure. To have a better understanding of this, see FIG. 3. It shows the structure of the first sand box 20. The first sand box 20 includes a square hollow frame 21 and 4 filter strips 22 installed on an inner side of the square hollow frame 21. The cross-sectional shape of the square hollow frame 21 is not limited and may be rectangular in this embodiment, but its peripheral shape must be square or rectangular. The square hollow frame 21 has 4 mutually perpendicular or parallel frames. Material of the square hollow frame 21 is not limited and may be stainless steel or aluminum alloy. An annular slotting 211 is formed on an inner side of the square hollow frame 21. Namely, cut or form 4 long straight openings on the inside of the frames, and connect each long straight opening to adjacent. At least one connecting pipe 212 is installed on an outer side of the square hollow frame 21. In the embodiment, there are two connecting pipes 212 located on opposite frames. In practice, the number of the connecting pipe 212 can be one. The connecting pipe 212 is used to connect an external negative pressure air extractor (not shown) to provide negative pressure. The formation method of the negative pressure will be described in detail later. Each one of the 4 filter strips 22 is fixed on one linear section of the annular slotting 211, respectively, and includes 2 long metal plates 221 and a long metal filter 222. Multiple ventilation holes 2111 are formed at corresponding positions between 2 long metal plates 221. Material of the long metal plates 221 may be stainless steel, aluminum alloy, copper alloy and other industrial solid metal materials. The appearance shape of the long metal filter 222 is the same as that of the long metal plate 221. The long metal filter 222 is fixed between the two long metal plates 221, allowing air to circulate but blocking dry sand S from passing through. That is to say the mesh size of the long metal filter 222 must be slightly smaller than the particle size of the dry sand S. Therefore, the particle size of the dry sand S used must be limited. According to the present invention, particle size of the dry sand S should be between 0.15 mm and 0.075 mm. Dry sand S can pass through a standard 100 mesh screen but cannot pass through a standard 200 mesh screen. The dry sand S can be compacted to a higher density through micro-vibration, such as beating the first sand box 20.

Secondly, the long metal filter 222 needs to withstand large compressive stress and friction. As in this embodiment, a tin phosphorus mesh can be used as the long metal filter 222. It should be noted that in order to facilitate operation and reduce friction during installation, the first sand box 20 can be assembled after spraying a release agent on all its surfaces and drying the release agent.

A third step of the method is smoothing the dry sand surface, placing a sprue cup C in the dry sand S, placing a heated and softened second EVA film 200 on the dry sand S covering the first sand box 20, exerting negative pressure between the first EVA film 100, the second EVA film 200 and the first sand box 20 through the first sand box 20 to harden the dry sand S, and then releasing the negative pressure exerted by the exhaust box B to separate the first EVA film 100 and the first mold 10, thereby forming an upper box 1 (S03). Smoothing the surface of the dry sand S can reduce the irregular spaces formed between the second EVA film 200 and the surface of the dry sand S. The sprue cup C is a tool used to pour high-temperature smelting aluminum liquid to form graphene aluminum casting. It is generally made of high-temperature resistant materials, such as clay, and has upper and lower openings. The lower opening of the sprue cup C can be placed above the sprue position, but does not penetrate the first EVA film 100. At this moment, the first EVA film 100, the second EVA film 200 and the first sand box 20 wrap the dry sand S and the sprue cup C. The negative pressure air extractor continuously extracts the air in the dry sand S and sprue cup C through the annular slotting 211 and the connecting pipe 212. The first EVA film 100, the second EVA film 200 and the first sand box 20 are exposed to atmospheric pressure on the outside, and only have negative pressure on the inside. The force caused by the pressure difference causes the first EVA film 100 and the second EVA film 200 to squeeze the dry sand S inward, making the dry sand S more compact. The upper box 1 formed by the first EVA film 100, the second EVA film 200, the first sand box 20 and the dry sand S (an upper part of the sand mold used to fix the smelting aluminum liquid) becomes very hard. It is like the vacuum-packed rice sold in supermarkets. To take out the upper box 1 and operate it freely, the negative pressure exerted by the exhaust box B must be released to separate the first EVA film 100 and the first mold 10.

Figure 4:
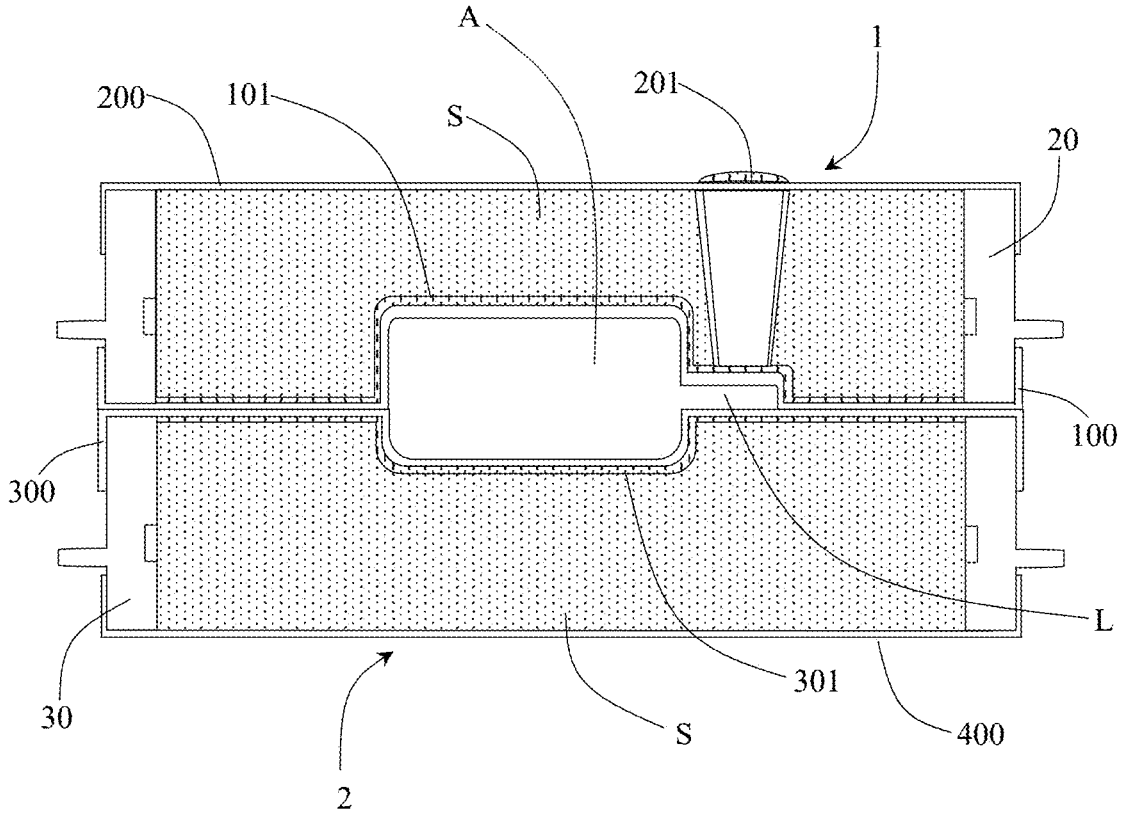
FIG. 4 shows the aspect of the upper box and a lower box when they are assembled.

Next, a fourth step of the method is using a third EVA film, a fourth EVA film, a second mold 12 and a second sand box to replace the first EVA film 100, the second EVA film 200, the first mold 10 and the first sand box 20 respectively and cancelling the use of the sprue cup C to repeat step S01 to step S03 so as to form a lower box (S04). To better understand this, see FIG. 4. It shows the aspect of the upper box 1 and a lower box 2 when they are assembled. The third EVA film 300, the fourth EVA film 400, and the second sand box 30 are as shown in the figure. However, the second mold 12 is not shown in the figure because it has been removed. Likewise, the third EVA film 300, the fourth EVA film 400 and the second sand box 30 are exposed to atmospheric pressure on the outside, and only have negative pressure on the inside. The force caused by the pressure difference causes the third EVA film 300 and the fourth EVA film 400 to squeeze the dry sand S inward, making the dry sand S more compact. The lower box 2 formed by the third EVA film 300, the fourth EVA film 400, the second sand box 30 and the dry sand S (a lower part of the sand mold used to fix the smelting aluminum liquid) also becomes very hard. It should be noted that a graphene powder layer 301 is also formed between the third EVA film 300 and the dry sand S. The thickness of the graphene powder layer 301 also depends on the size of graphene aluminum casting and the graphene concentration required on the surface, and is not limited by the present invention.

Next, a fifth step of the method is assembling the upper box 1 and the lower box 2 with a casting space A and a sprue L formed therebetween, and sprinkling graphene powder on a portion of the second EVA film 200 above the sprue cup C (S05). Operation of assembling the upper box 1 and the lower box 2 is the same as that in ordinary aluminum casting, but the form of the sand mold is slightly different. In addition, graphene powder 201 is sprinkled on the portion of the second EVA film 200 above the sprue cup C, e.g. 20 grams. The purpose is to make the graphene on the surface of the graphene aluminum casting formed by the poured smelting aluminum liquid more uniform.

Figure 5:
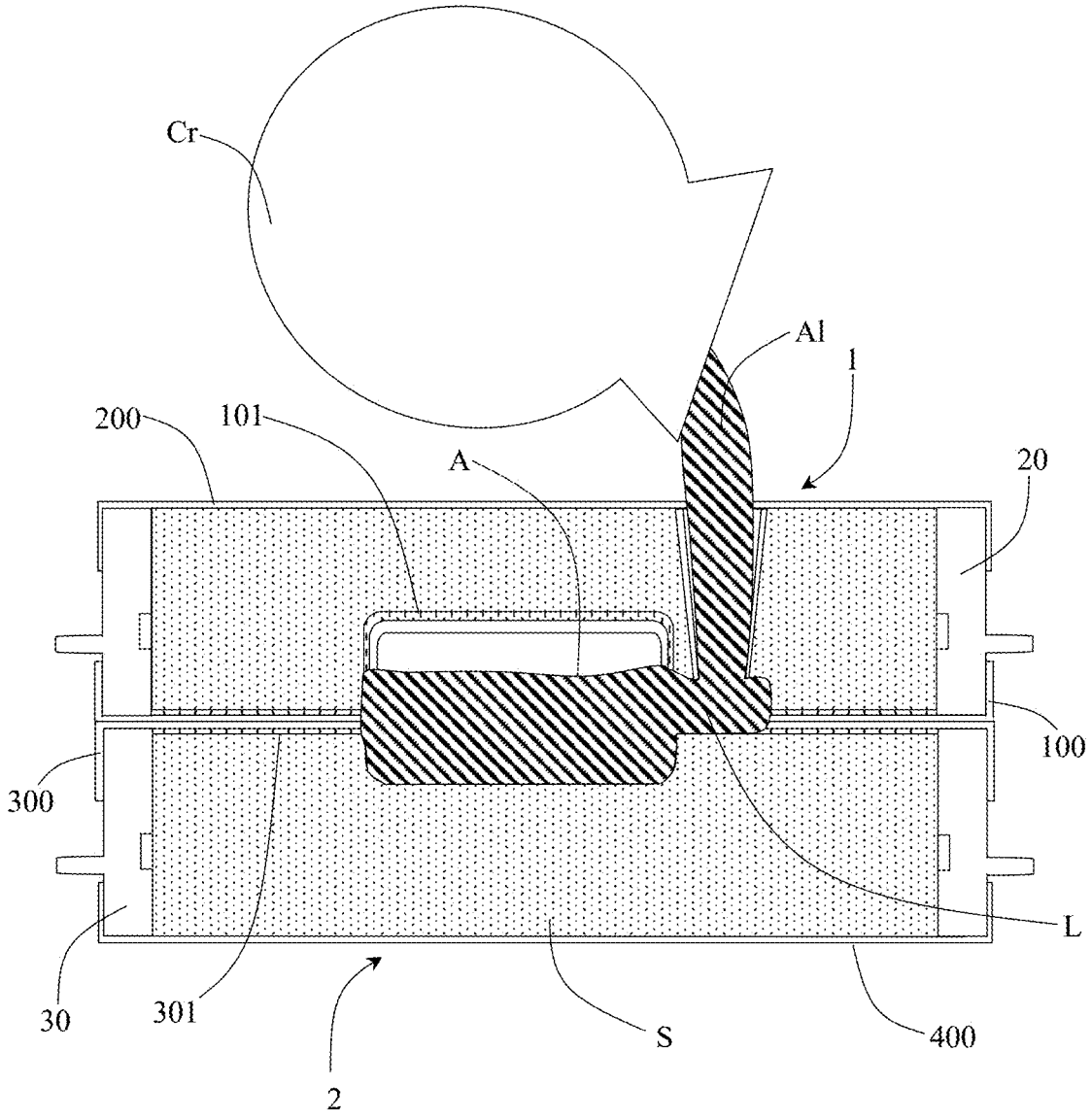
FIG. 5 shows the aspect when pouring smelting aluminum liquid.
Figure 6:
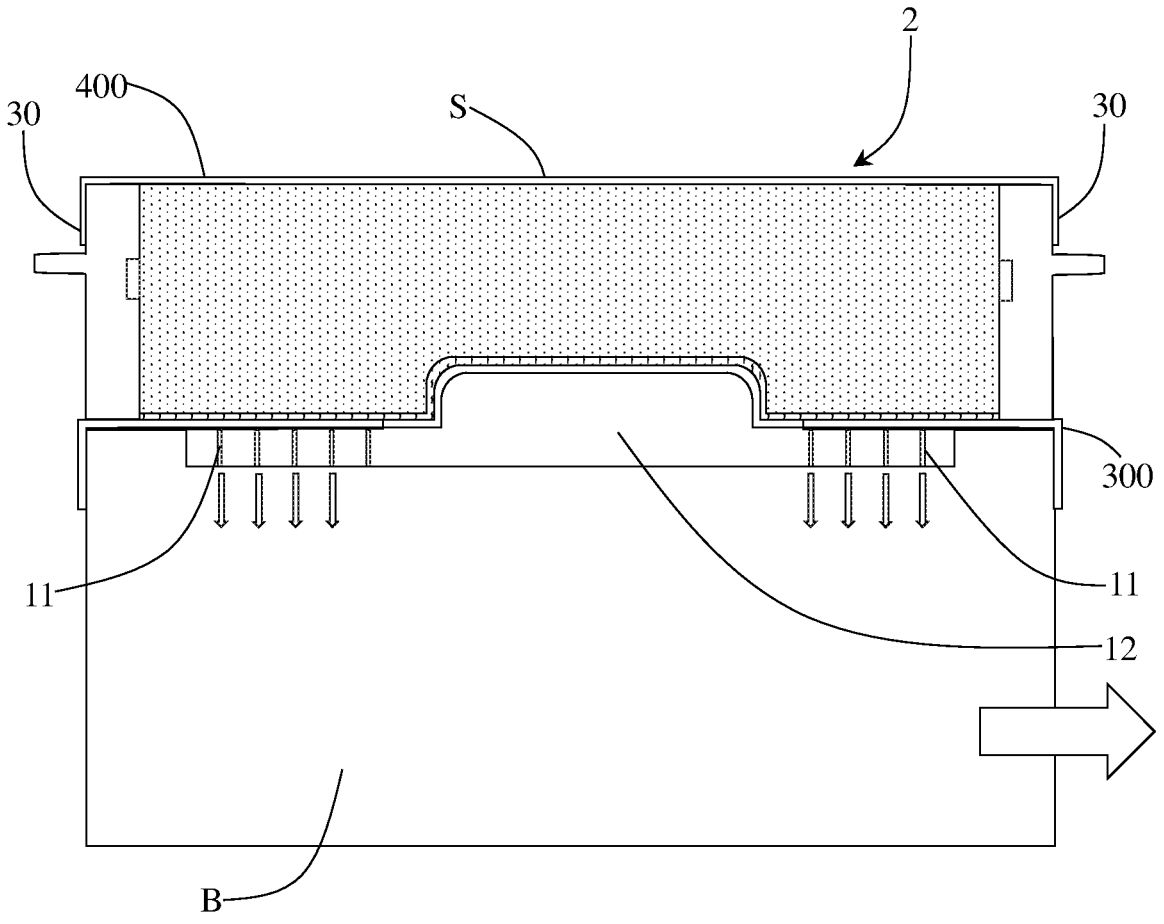
FIG. 6 illustrates how to make a lower box.

A sixth step of the method is adding graphene powder to the smelting aluminum liquid and mixing, and pouring the mixed smelting aluminum liquid to the portion of the second EVA film 200 above the sprue cup C, wherein after vaporizing the portion of the second EVA film 200 above the sprue cup C, the mixed smelting aluminum liquid goes through the sprue L to fill the casting space A (S06). See FIG. 5. It shows the aspect when pouring smelting aluminum liquid. The smelting aluminum liquid Al is heated molten aluminum, placed in the crucible Cr. The temperature of the smelting aluminum liquid Al does not need to be too high, such as between 750° C. and 790° C. The heat energy contained in this temperature is enough to vaporize or decompose the EVA film, but it is not enough to melt the graphene powder; the smelting aluminum liquid Al is allowed to have sufficient fluidity, but the heat energy does not need to be too much. Here, the graphene powder will be uniformly formed inside the graphene aluminum casting, so its dosage is determined by the graphene concentration of the graphene aluminum casting itself, and can be added according to the designed concentration. After the graphene powder poured into the crucible Cr, it is stirred evenly with the smelting aluminum liquid Al by mechanical means. When pouring, the mixed smelting aluminum liquid Al first contacts the graphene powder 201, and its heat causes the portion of the second EVA film 200 above the sprue cup C to vaporize in a short time. The mixed smelting aluminum liquid Al flows downward along the inner wall of sprue cup C, gradually fills the casting space A and sprue L, and vaporizes or decomposes the first EVA film 100 and the third EVA film 300 there. The vaporized or decomposed EVA film molecules are affected by negative pressure and move toward the gaps in the adjacent dry sand S. The molecules are cooled by the dry sand S and affected by the continuous negative pressure to seal the gaps in the adjacent dry sand S, maintaining the appearance of the casting space A and the sprue L without expanding too much. The graphene powder in the graphene powder layers 101 and 301 is bonded to the surface of the mixed smelting aluminum liquid Al, so that the surface of the graphene aluminum casting formed in the future will have a uniform layer of graphene.

At last, a seventh step of the method is cooling the smelting aluminum liquid Al to a solid state, releasing the negative pressure exerted to the two sand boxes, and taking out a graphene aluminum casting formed in the casting space A (S07). After an appropriate cooling time, the pressure in the two sand boxes is restored to atmospheric pressure, and the sand molds automatically collapse. After the graphene aluminum casting is kept warm for a certain period of time, take it out, cut off the sprue and polish the blank to obtain a final product. Since the vaporized or decomposed EVA film molecules escape into the surrounding air in high temperature after the upper and lower sandboxes disintegrate, the dry sand can be reused after cooling.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A method for manufacturing graphene aluminum casting, comprising the steps of:

a) heating a first EVA (Ethylene Vinyl Acetate) film to soften, then placing the first EVA film on a surface of a first mold, wherein the first mold is placed above an exhaust box, the exhaust box exerts negative pressure between the first EVA film and the first mold to make the first EVA film closely adhere to an upper surface of the exhaust box, and graphene powder is sprinkled evenly on a surface of the first EVA film above the first mold;

b) placing a first sand box on the first EVA film, sealing the first sand box with an upper plane of the exhaust box through the first EVA film, pouring dry sand into the first sand box and shaking the first sand box to increase dry sand density and fill all parts of the first sand box with the dry sand;

c) smoothing a surface of the dry sand, placing a sprue cup in the dry sand, placing a heated and softened second EVA film on the dry sand covering the first sand box, exerting negative pressure between the first EVA film, the second EVA film, and the first sand box through the first sand box to harden the dry sand, and then releasing the negative pressure exerted by the exhaust box to separate the first EVA film and the first mold, thereby forming an upper box;

d) using a third EVA film, a fourth EVA film, a second mold, and a second sand box to replace the first EVA film, the second EVA film, the first mold, and the first sand box, respectively, and not using the sprue cup to repeat step a) to step c) so as to form a lower box;

e) assembling the upper box and the lower box with a casting space and a sprue formed therebetween, and sprinkling graphene powder on a portion of the second EVA film above the sprue cup;

f) adding graphene powder to a smelting aluminum liquid and mixing, and pouring the smelting aluminum liquid mixed with graphene to the portion of the second EVA film above the sprue cup, wherein after vaporizing the portion of the second EVA film above the sprue cup, the smelting aluminum liquid mixed with graphene goes through the sprue to fill the casting space; and g) cooling the smelting aluminum liquid to a solid state, releasing the negative pressure exerted to the first sand box and the second sand box, and taking out a graphene aluminum casting formed in the casting space, wherein a shape of a combination of a portion of the first mold and a portion of the second mold is the same as that of the casting space.

2. The method for manufacturing graphene aluminum casting according to claim 1, wherein the negative pressure is between 200 mmHg and 400 mmHg.

3. The method for manufacturing graphene aluminum casting according to claim 1, wherein particle size of the dry sand is between 0.15 mm and 0.075 mm.

4. The method for manufacturing graphene aluminum casting according to claim 1, wherein temperature of the smelting aluminum liquid is between 750° C. and 790° C.

5. The method for manufacturing graphene aluminum casting according to claim 1, wherein the first sand box and the second sand box both comprise:

a square hollow frame, having an annular slotting formed on an inner side thereof and at least one connecting pipe installed on an outer side thereof; and four filter strips, each filter strip fixed on one linear section of the annular slotting respectively, comprising:

two long metal plates, having a plurality of ventilation holes formed correspondingly; and a long metal filter, fixed between the two long metal plates, allowing air to circulate but blocking dry sand from passing through.

6. The method for manufacturing graphene aluminum casting according to claim 5, wherein the long metal filter is tin phosphorus mesh.

7. The method for manufacturing graphene aluminum casting according to claim 1, wherein the first mold and the second mold both have multiple exhaust holes, so that the exhaust box is able to exert negative pressure through the exhaust holes.

* * * * *